US010465627B2

(12) United States Patent
Smith et al.

(10) Patent No.: US 10,465,627 B2
(45) Date of Patent: Nov. 5, 2019

(54) ROUGH CAST CYLINDER LINER

(71) Applicant: MAHLE International GmbH, Stuttgart (DE)

(72) Inventors: Thomas Smith, Muskegon, MI (US); Steffen Rudolph, Weissach (DE); Jesús Antonio Magallanes Castañeda, Coahuila (MX)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 15/966,187

(22) Filed: Apr. 30, 2018

(65) Prior Publication Data

US 2018/0245537 A1 Aug. 30, 2018

Related U.S. Application Data

(63) Continuation of application No. 15/414,846, filed on Jan. 25, 2017, now Pat. No. 10,215,128.

(60) Provisional application No. 62/328,097, filed on Apr. 27, 2016.

(51) Int. Cl.

| | |
|---|---|
| ***F02F 1/00*** | (2006.01) |
| ***F02F 1/16*** | (2006.01) |
| *F02F 1/14* | (2006.01) |
| *F02F 1/10* | (2006.01) |

(52) U.S. Cl.

CPC ..... *F02F 1/004* (2013.01); *F02F 1/102* (2013.01); *F02F 1/14* (2013.01); *F02F 1/163* (2013.01); *F02F 2200/06* (2013.01)

(58) Field of Classification Search

CPC .. F02F 1/004; F02F 1/102; F02F 1/014; F02F 1/163; F02F 2200/06

See application file for complete search history.

(56) References Cited

U.S. PATENT DOCUMENTS

| | | | |
|---|---|---|---|
| 5,855,700 | A | 1/1999 | Guerard |
| 6,468,673 | B2 | 10/2002 | Saito |
| 6,699,314 | B2 | 3/2004 | Takeo et al. |
| 7,171,935 | B2 | 2/2007 | Komai et al. |
| 7,226,667 | B2 | 6/2007 | Kodama et al. |
| 7,383,805 | B2 | 6/2008 | Michioka et al. |
| 7,533,647 | B2 | 5/2009 | Miyamoto et al. |
| 7,665,440 | B2 | 2/2010 | Holtan et al. |

(Continued)

FOREIGN PATENT DOCUMENTS

| | | |
|---|---|---|
| CN | 104588572 A | 5/2015 |
| CN | 104595050 A | 5/2015 |

(Continued)

OTHER PUBLICATIONS

German Search Report in DE 10 2017 206 858.2 dated Feb. 27, 2018 with English translation of relevant parts.

*Primary Examiner* — Syed O Hasan

(74) *Attorney, Agent, or Firm* — Collard & Roe, P.C.

(57) ABSTRACT

A cylinder liner for internal combustion engines has an outer roughened surface that has particularly good adherence properties. The surface has is covered with protrusions or spines of varying shapes and sizes, which are created by spraying the mold with a coating and then casting the cylinder liner in the mold. The spines are generally worm-shaped, with a length greater than a width, and a large spacing between the spines.

9 Claims, 15 Drawing Sheets

(56) References Cited

U.S. PATENT DOCUMENTS

| | | | | |
|---|---|---|---|---|
| 7,806,098 | B2 * | 10/2010 | Bing | B22D 19/0009 123/193.2 |
| 8,402,881 | B2 | 3/2013 | Sato et al. | |
| 9,500,282 | B2 | 11/2016 | He et al. | |
| 2003/0056645 | A1 * | 3/2003 | Land | F02F 1/004 123/193.2 |
| 2007/0012177 | A1 | 1/2007 | Miyamoto et al. | |
| 2012/0304852 | A1 | 12/2012 | Yamagata et al. | |
| 2015/0122118 | A1 * | 5/2015 | He | C23C 4/04 92/171.1 |

FOREIGN PATENT DOCUMENTS

| | | | |
|---|---|---|---|
| CN | 204386752 | U | 6/2015 |
| DE | 10 2004 062 527 | A1 | 7/2005 |
| DE | 10 2009 043 566 | A1 | 4/2011 |
| DE | 20 2013 100 551 | U1 | 4/2013 |

* cited by examiner

FIG. 2
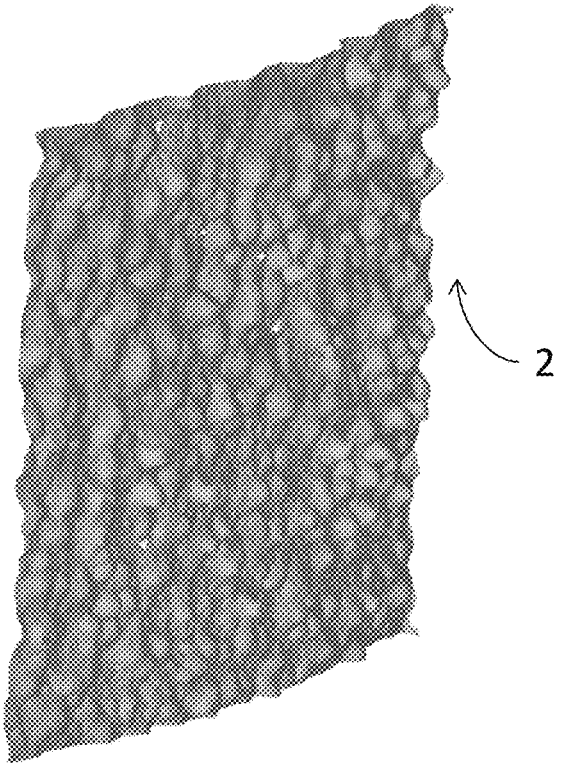
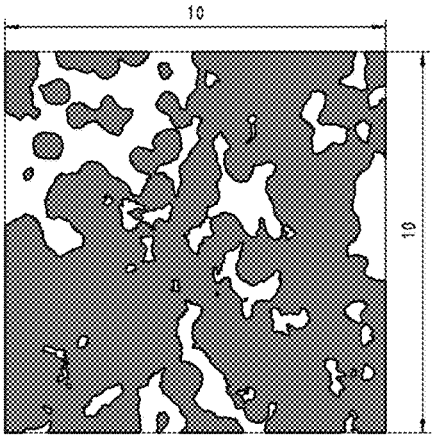
FIG. 3
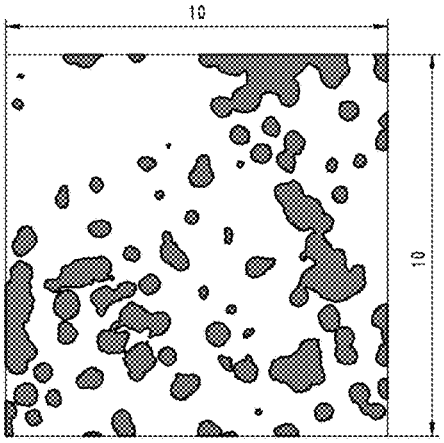
FIG. 4

*Figure 2-2 Example of a comparison chart (Santomarma and Cho, 2004)*

ROUGH CAST CYLINDER LINER

CROSS-REFERENCE TO RELATED APPLICATIONS

This application is a continuation under 35 USC 120 of U.S. patent application Ser. No. 15/414,846, filed on Jan. 25, 2017, which claims priority under 35 USC 119(e) of U.S. Provisional Application Ser. No. 62/328,097, filed on Apr. 27, 2016, the disclosures of which are herein incorporated by reference.

BACKGROUND OF THE INVENTION

1. Field of the Invention

The present invention relates to a cylinder liner for internal combustion engines. In particular, the invention relates to a cylinder liner that has a rough exterior surface that is formed during the casting process, the surface having spines of different shape and structure to facilitate adherence of the liner to the engine block.

2. The Prior Art

In combustion engines having an engine block made of a cast iron alloy or an aluminum alloy, cylinder liners are usually inserted into the cylinder bores of the engine block. The liners consist of cylindrical pipe sections and their inner surfaces define the combustion space of the combustion chamber of the engine. The outer surfaces are often treated to give the outer surface a roughened texture. This rough texture ensures adhesion of the cylinder liner to the engine block when the liner is cast into the engine block.

Some cylinder liners, such as the one shown in U.S. Pat. No. 7,171,935 to Komai, have been treated so that the exterior surface of the liner has a series of spines extending out from the liner. Other liners, such as U.S. Pat. No. 7,665,440 to Holtan et al. describe grit-blasting the outer surface of the cylinder liner so that the outer surface has cavities throughout. German Patent No. DE102009043566A1 to Bischofberger et al. describes a cylinder liner that is created with a textured surface that can have grooves, ribs, shafts, studs, mushrooms, thorns or a combination thereof. This texture can be created by removing material from the liner or by a coating.

U.S. Pat. No. 8,402,881 to Sato et al. discloses an insert casting structure having a rough-cast surface with spines of specific diameters. Based on the measurements, it can be determined that the spines have a more or less cylindrical shape.

SUMMARY OF THE INVENTION

The present invention relates to a cylinder liner for internal combustion engines that has an outer roughened surface that has particularly good adherence properties. The surface has is covered with protrusions or spines of varying shapes and sizes, which are created by spraying the mold with a coating and then casting the cylinder liner in the mold. The spines are generally conical or needle-shaped, with the bases being larger than the tips.

The coating can be formed by spraying the mold used to cast the cylinder liner with a coating material during a centrifugal casting process. First, the mold is sprayed with the coating while rotating so that the mold surface is coated evenly. Then, the casting material is poured into the mold and allowed to solidify. The mold is rotating during the coating, casting and solidifying process.

The coating is prepared in such a way that spines of a specific shape, size and pattern are arranged around the cylinder. These spines are preferably arranged in a density of between 110-190 spines/cm$^2$ and preferably around 120-125 spines/cm$^2$. The spines preferably have a surface area of the rough structure compared to the cylindrical ground surface of 120-180%. Due to the conical nature of the spines, it is possible also to measure the surface area covered by the spines at certain heights as compared to the overall cylindrical ground surface. In the present invention, the surface area covered by the spines at 0.2 mm height is approximately 50-90% of the cylindrical ground surface. This area at 0.4 mm height is between 20-45% of the area of the cylindrical ground surface. The distance between the spines as measured from their peaks ranges between 0.09-1.52 mm, with an average distance of 0.64 mm.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 2 is a section of a cylinder according to the present invention;

FIG. 3 is a topographical cross-section at 0.2 mm from the cylindrical ground surface of the cylinder of FIG. 2;

FIG. 4 is a topographical cross section at 0.44 mm from the cylindrical ground surface of the cylinder of FIG. 2;

DETAILED DESCRIPTION OF THE PREFERRED EMBODIMENTS

Figure 1:
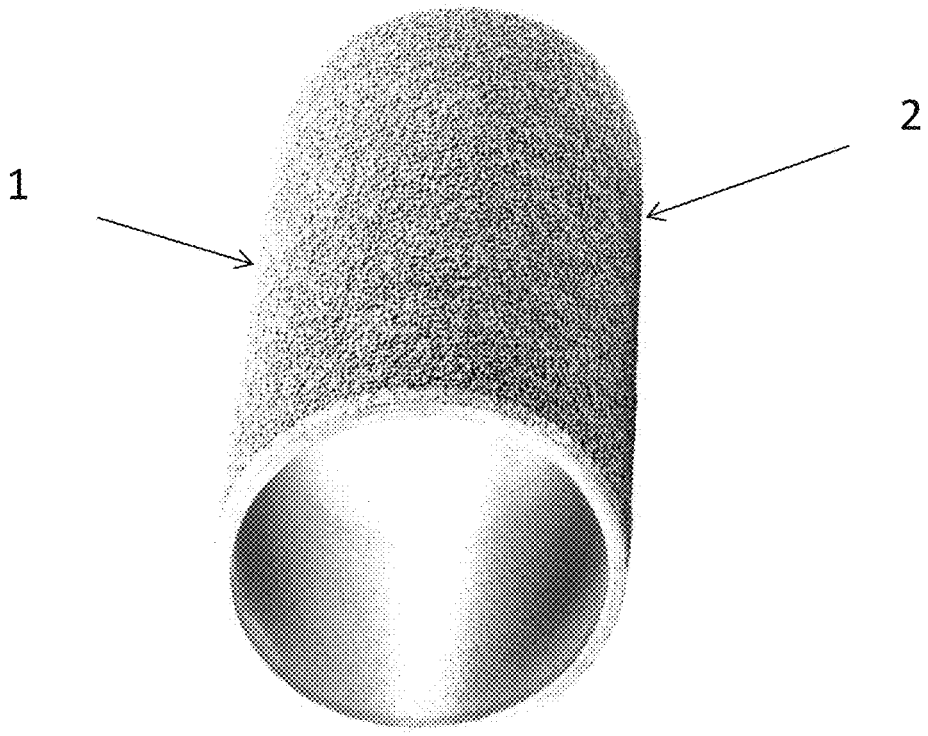
FIG. 1 shows a view of cylinder liner according to the invention.

As shown in FIG. 1, cylinder liner 1 according to the invention has a roughened surface 2 formed from spines of generally conical or needle shape, with a surface area of the base of the spines being larger than a surface area at a midpoint or tip of the spines.

To form cylinder liner 1, a coating is applied to the mold used to cast the cylinder liner, so that the coating imprints its structure onto the cast cylinder liner. A centrifugal casting method is used to cast the liner so that the exterior of the liner is imprinted with spines of specific size, shape and density. The spines generally have a height of between 0.1-1.1 mm and a density of between 110-300 spines/cm$^2$. In one form, the spines have a height of between 0.25-0.85 mm and a density of between 110-190 spines/cm$^2$. The density may be adjusted through various processing steps of the coating and how it is applied to the mold. The density of the spines may be adjusted to accommodate the processing and mold technique of the engine block to insure proper seating and interconnection between the liner and the engine block. For example, if the engine block is molded using high pressure die casting technique the liner may have a higher density of spines and in one example is in the range of 160-200 spines/cm$^2$.

Other engine block molding techniques such as precision gravity sand cast or low pressure sand cast the liner spine geometry may include a lower density of spines allowing for an increase opening or spacing between the spines to facilitate the flow of the engine block material into the spines structures before the setting of the material around the cylinder liners. In the lower pressure sand casting techniques the liner may have a spine density of 120-160 spines/cm$^2$.

Figure 5:
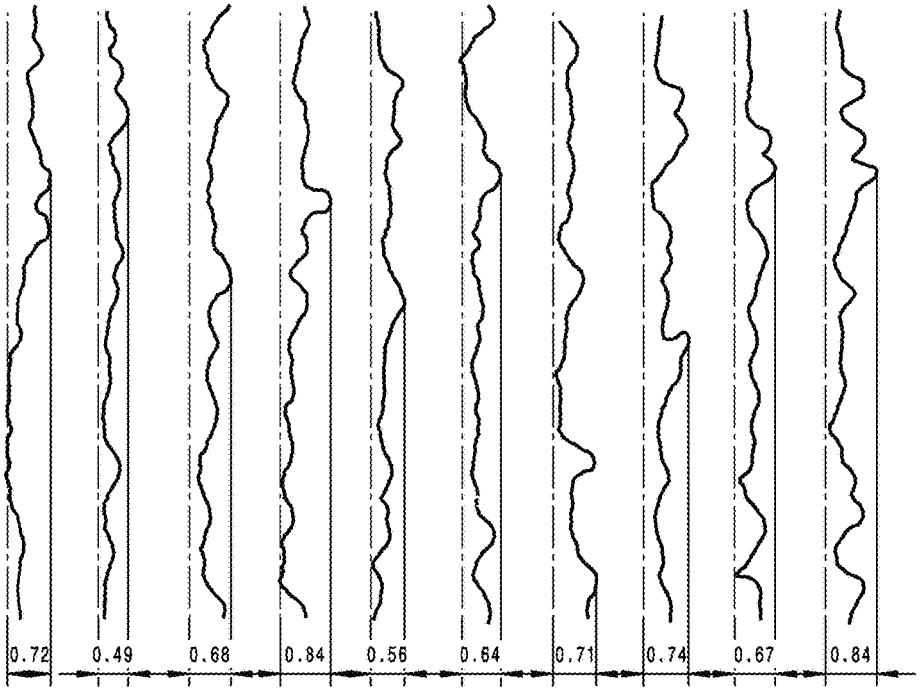
FIG. 5 shows radial cross sections of the cylinder of FIG. 2, taken 1 mm apart.
Figure 6:
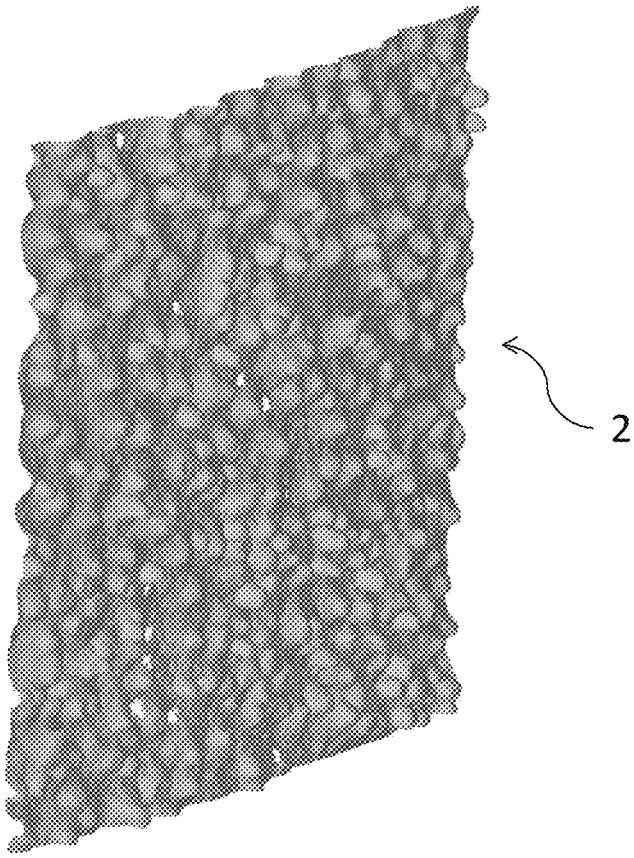
FIG. 6 is a section of another cylinder according to the present invention.
Figure 7:
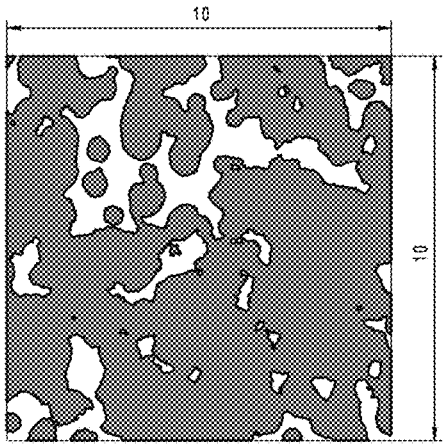
FIG. 7 is a topographical cross-section at 0.2 mm from the cylindrical ground surface of the cylinder of FIG. 6.

FIGS. 2-21 show sections of the cast cylinder liner according to the invention, as well as topographic images of sections of the liner at 0.2 mm and 0.4 mm from the base and cross-sectional views of the spines. For example, FIG. 2 shows a section of roughened surface 2 having a surface area rough structure compared to the cylindrical ground diameter surface of 125%. As shown in FIG. 3, the cylindrical cross section is taken at a 0.2 mm radial distance from the ground diameter shows that 73.2% of the surface is covered with spines. The spines have a needle-like or cone-like structure, so at higher points along the spine, less of the cylinder is covered. As can be seen in FIG. 4, the cylindrical cross-section is taken at 0.4 mm from the cylinder ground diameter shows only 23.1% coverage. Radial cross-sections of the spines at 1 mm intervals across the cylinder can be seen in FIG. 5. The unique worm-like or volcano-shaped spines of the present invention also have an increased perimeter measurement in comparison to a circular or oval shaped spine, as discussed below in FIGS. 24 and 25.

Figure 8:
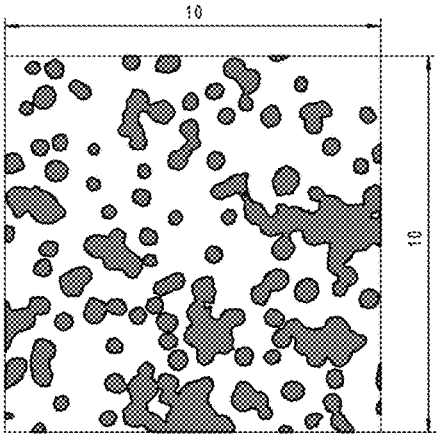
FIG. 8 is a topographical cross section at 0.44 mm from the cylindrical ground surface of the cylinder of FIG. 6.
Figure 9:
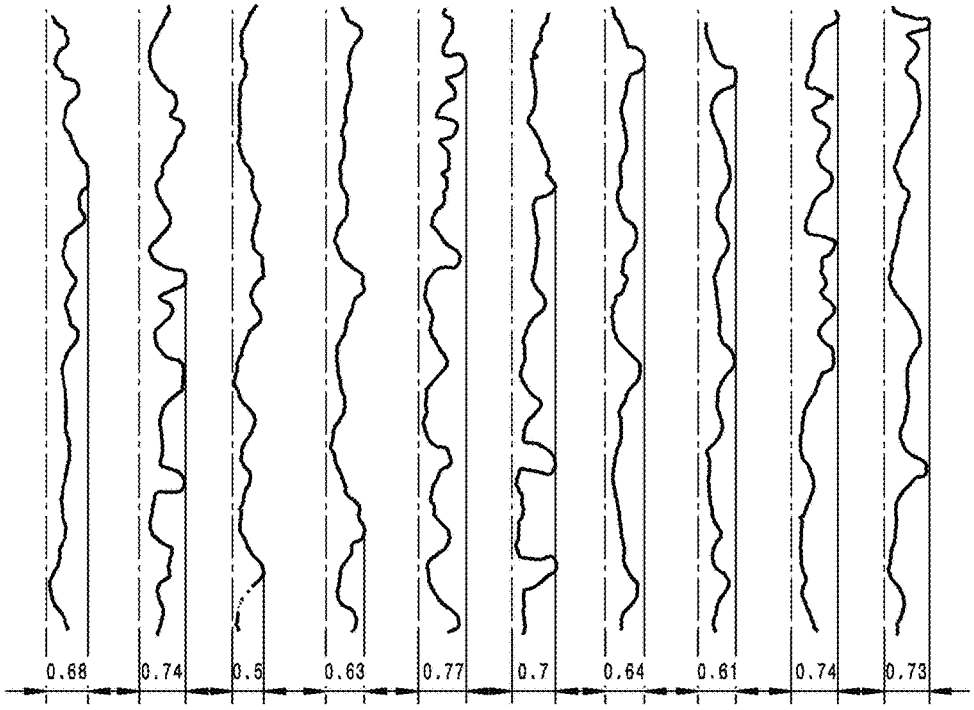
FIG. 9 shows radial cross sections of the cylinder of FIG. 6, taken 1 mm apart.
Figure 10:
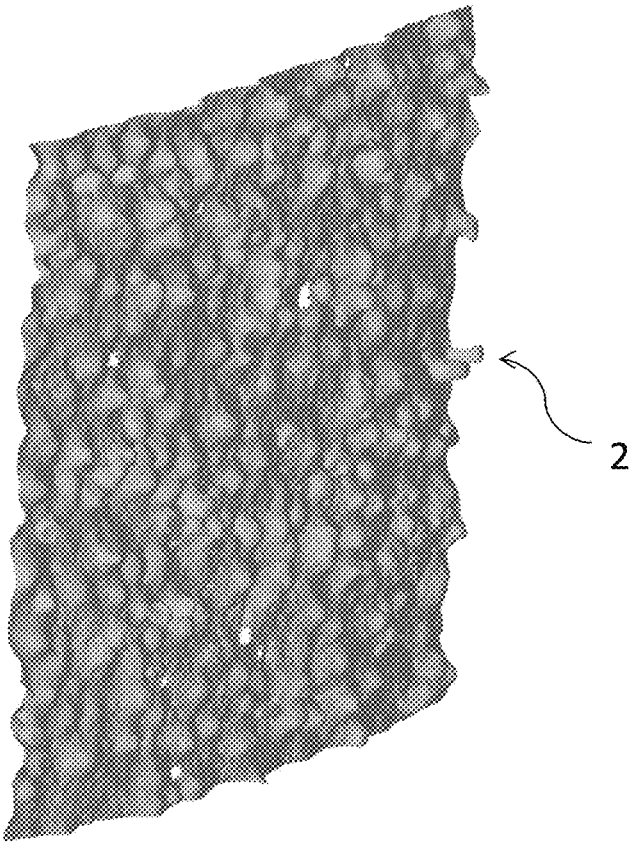
FIG. 10 is a section of a cylinder according to the present invention.
Figure 11:
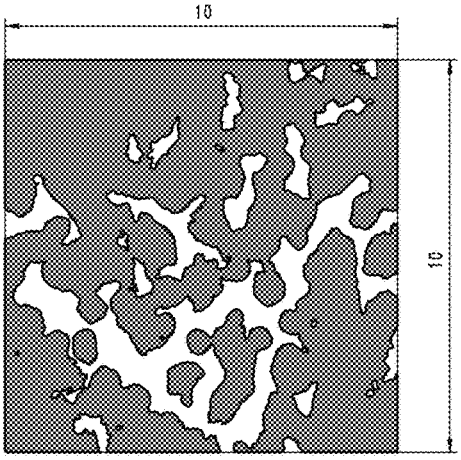
FIG. 11 is a topographical cross-section at 0.2 mm from the cylindrical ground surface of the cylinder of FIG. 10.
Figure 12:
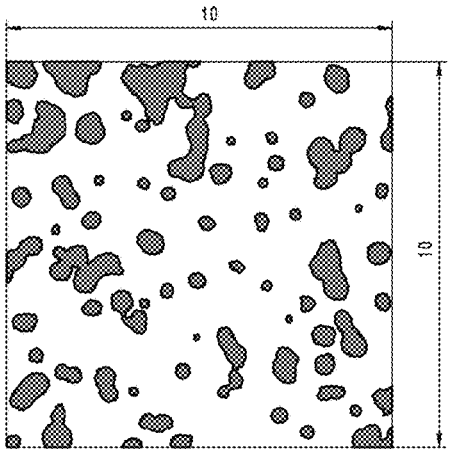
FIG. 12 is a topographical cross section at 0.44 mm from the cylindrical ground surface of the cylinder of FIG. 10.
Figure 13:
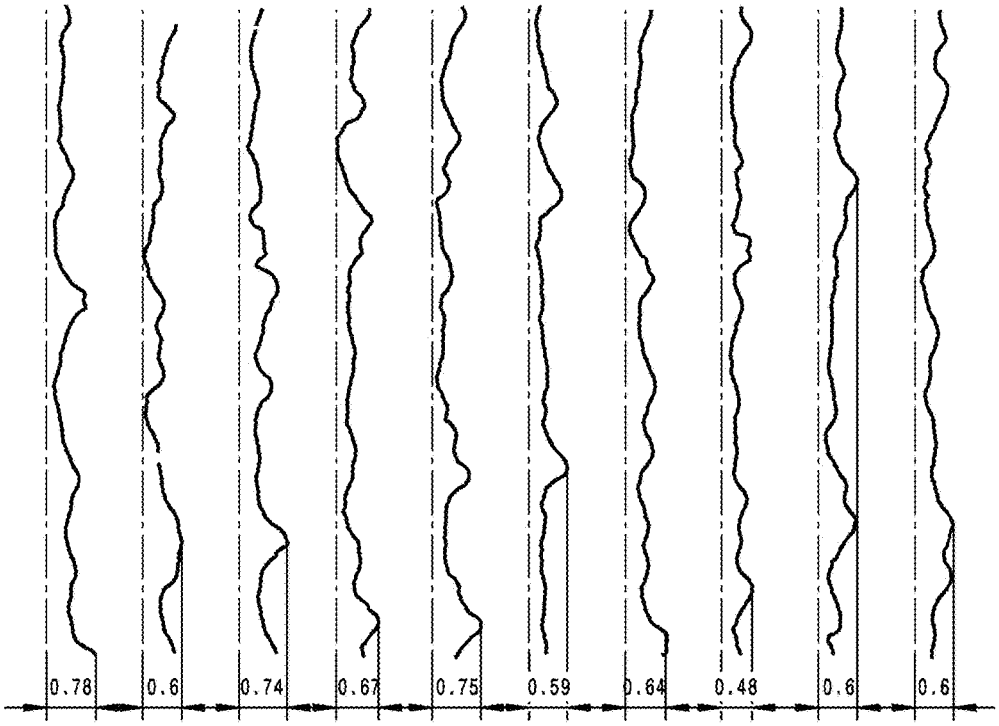
FIG. 13 shows radial cross sections of the cylinder of FIG. 10, taken 1 mm apart.
Figure 14:
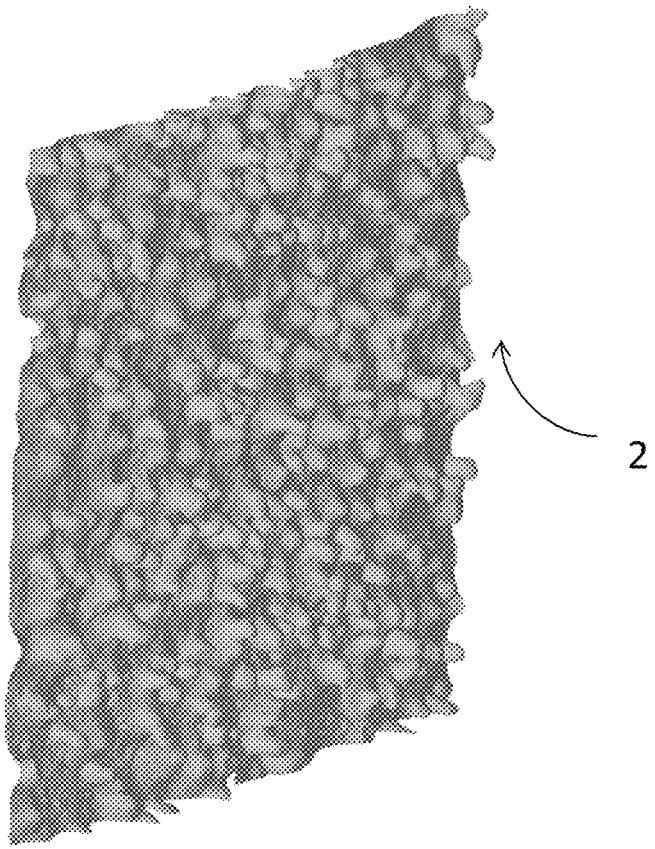
FIG. 14 is a section of a cylinder according to the present invention.
Figure 15:
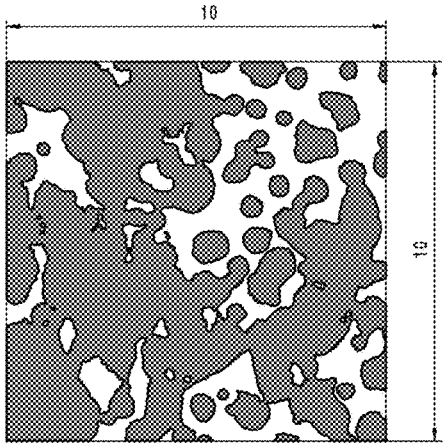
FIG. 15 is a topographical cross-section at 0.2 mm from the cylindrical ground surface of the cylinder of FIG. 14.
Figure 16:
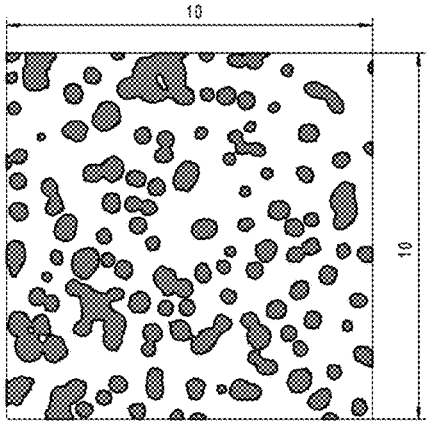
FIG. 16 is a topographical cross section at 0.44 mm from the cylindrical ground surface of the cylinder of FIG. 14.
Figure 17:
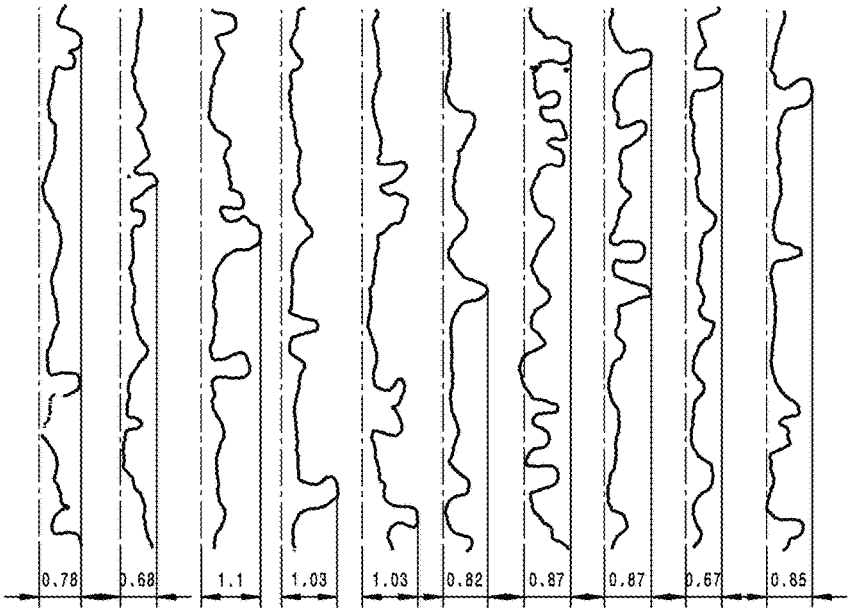
FIG. 17 shows radial cross sections of the cylinder of FIG. 14, taken 1 mm apart.
Figure 18:
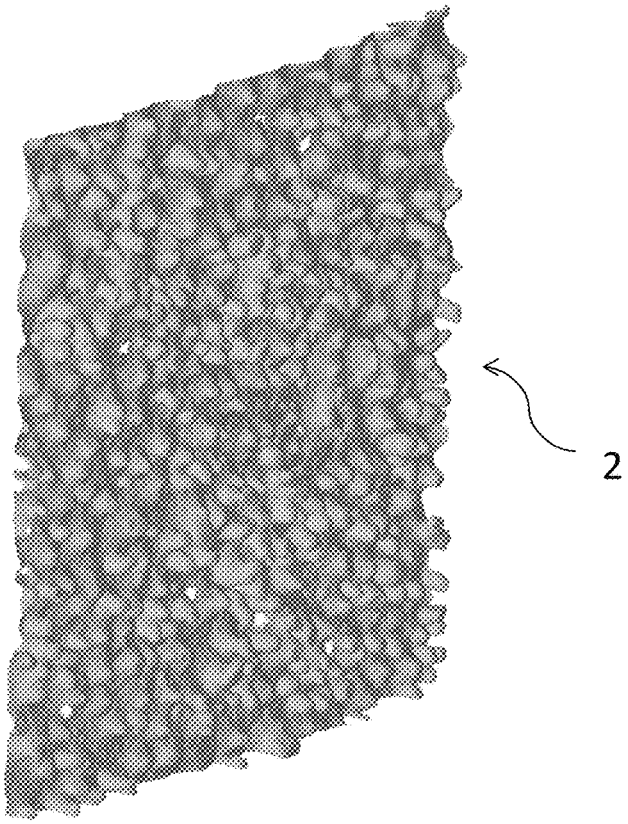
FIG. 18 is a section of a cylinder according to the present invention.
Figure 19:
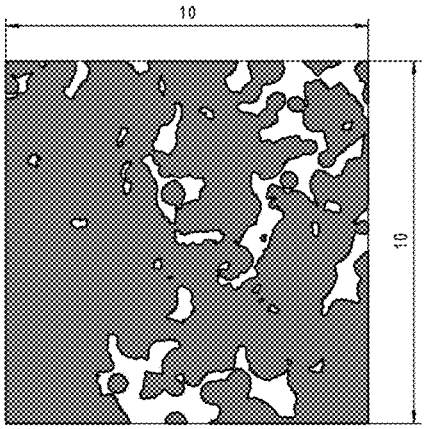
FIG. 19 is a topographical cross-section at 0.2 mm from the cylindrical ground surface of the cylinder of FIG. 18.
Figure 20:
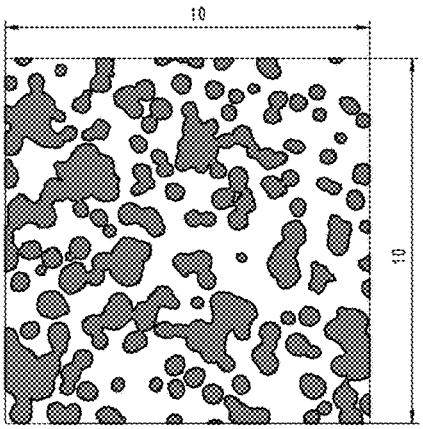
FIG. 20 is a topographical cross section at 0.44 mm from the cylindrical ground surface of the cylinder of FIG. 18.
Figure 21:
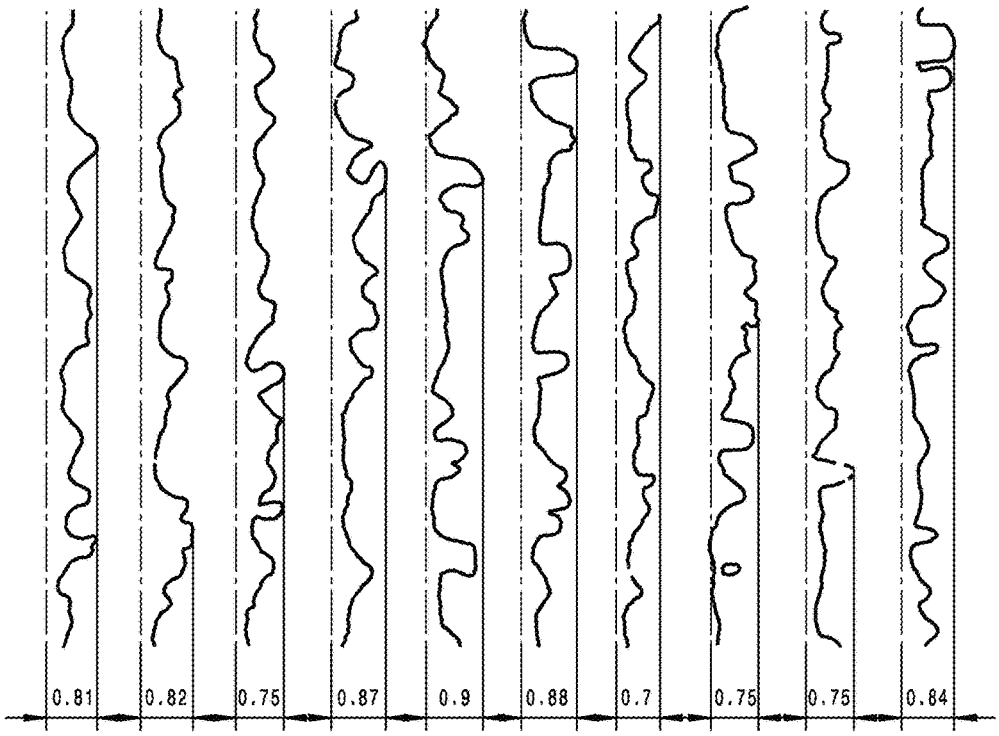
FIG. 21 shows radial cross sections of the cylinder of FIG. 18, taken 1 mm apart.

FIGS. 6-9 show another section of a roughened surface 2 of a cylinder liner according to the invention. This section has a a cross-sectional surface area at 0.2 mm that covers 77.6% of the cylindrical ground surface (FIG. 7) and a cross-sectional surface area at 0.4 mm that covers 29.8% of the cylindrical ground surface (FIG. 8). The spine configuration at radial cross sections can be seen in FIG. 9.

FIGS. 10-13 show another roughened surface 2 of a cylinder liner section according to the invention, this one having a cross-sectional surface area at 0.2 mm (FIG. 11) that covers 76.2% of the cylindrical ground surface and a cross-sectional surface area at 0.4 mm (FIG. 12) that covers 21.0% of the cylindrical ground surface. The spine configuration at radial cross sections can be seen in FIG. 13.

FIGS. 14-17 show another cylinder liner section, this one having a cross-sectional surface area at 0.2 mm (FIG. 15) that covers 67.8% of the cylindrical ground surface and a cross-sectional surface area at 0.4 mm (FIG. 16) that covers 26.4% of the cylindrical ground surface. The spine configuration at radial cross sections can be seen in FIG. 17.

FIGS. 18-21 show another cylinder liner section, this one having a cross-sectional surface area at 0.2 mm (FIG. 19) that covers 83.3% of the cylindrical ground surface and a cross-sectional surface area at 0.4 mm (FIG. 20) that covers 40.2% of the cylindrical ground surface. The spine configuration at radial cross sections can be seen in FIG. 21.

The spines are arranged so that they are separated by a defined distance, preferably 0.09-1.52 mm.

Figure 22:
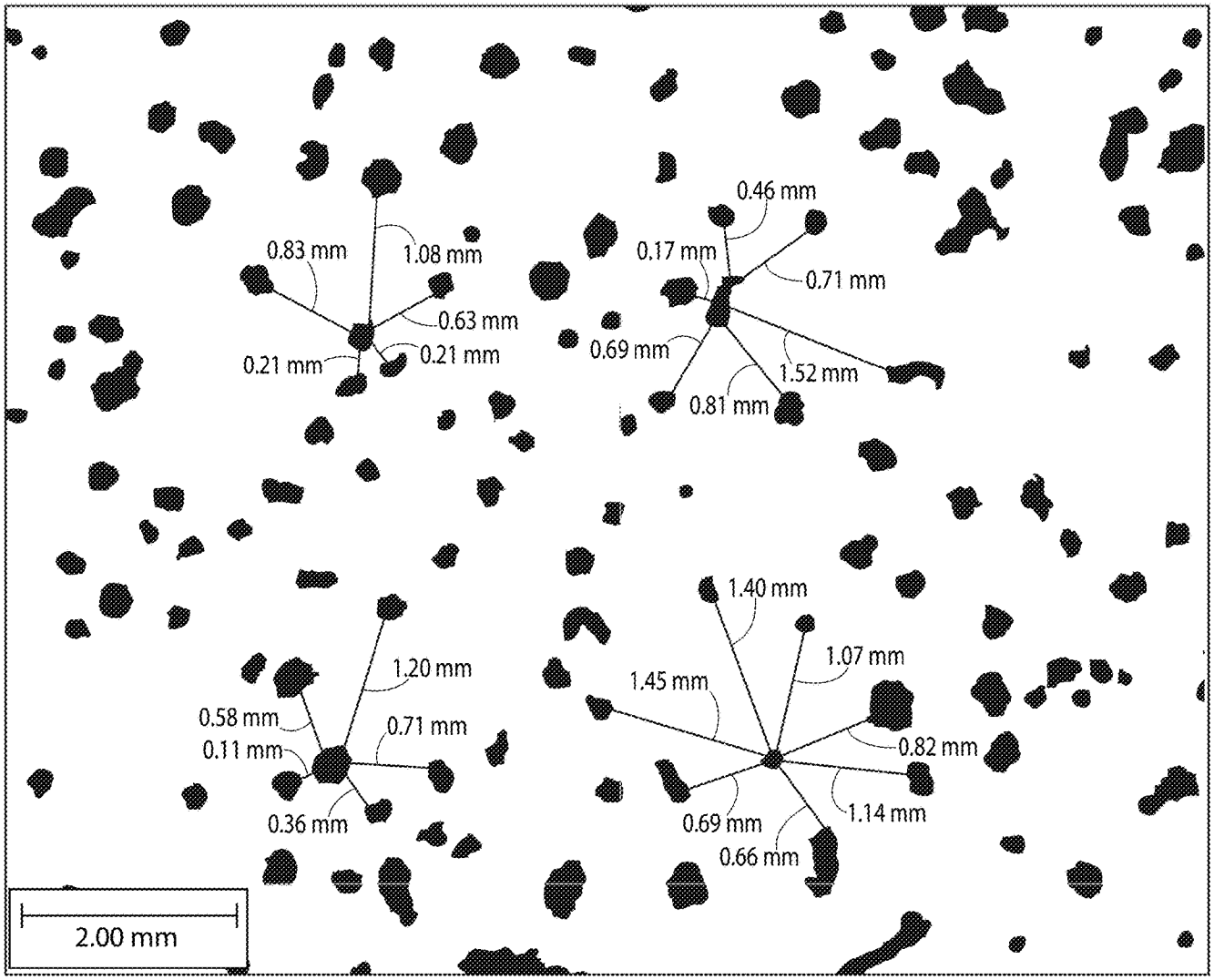
FIG. 22 is a topographical section of another cylinder liner, shown at the peaks of the spines.
Figure 23:
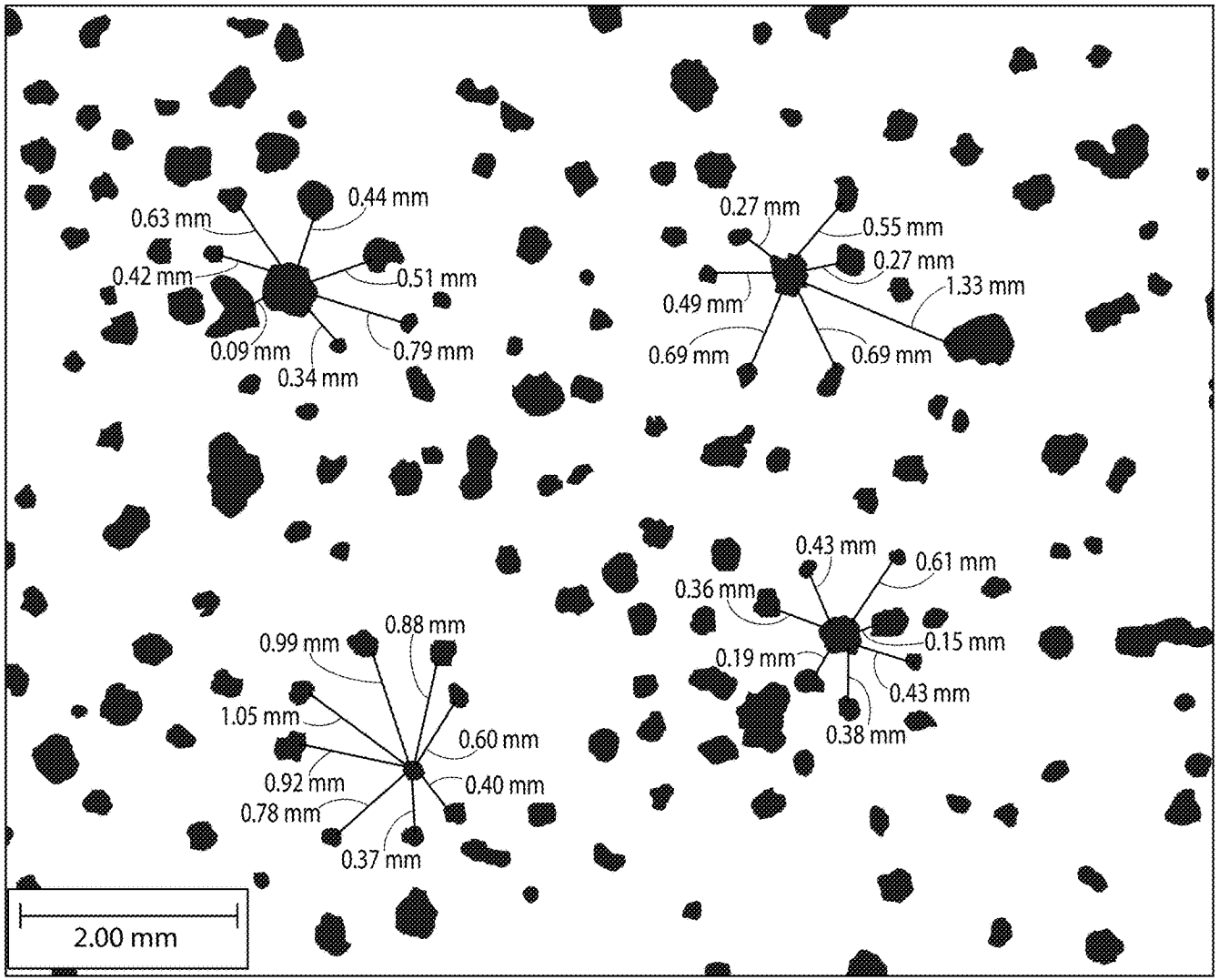
FIG. 23 is a topographical section of another cylinder liner, shown at the peaks of the spines.

FIGS. 22-23 show topographical images of the spines and distance measurements between peaks of the spines in the cylinder liner according to the invention taken in a 100 mm$^2$ section. The spine dimensions are also measured at the peak of each spine.

Table 1 shows the dimensions the spines in the section shown in FIG. 22.

TABLE 1

| | Short Dimension (mm) | Long Dimension (mm) | Area (mm$^2$) | Perimeter (mm) | Circularity $\frac{4\pi \times \text{Area}}{(\text{Perimeter})^2}$ | Spine Distance (mm) |
|---|---|---|---|---|---|---|
| Average | 0.22 | 0.31 | 0.05 | 1.12 | 0.50 | 0.76 |
| Median | 0.22 | 0.29 | 0.05 | 1.08 | 0.51 | 0.71 |
| Std. Dev. | 0.06 | 0.09 | 0.03 | 0.33 | 0.10 | 0.41 |
| Max | 0.43 | 0.54 | 0.15 | 2.08 | 0.71 | 1.52 |
| Min | 0.12 | 0.13 | 0.01 | 0.45 | 0.26 | 0.11 |

The spines in the liner shown in FIG. 22 are separated by a distance of between 0.11-1.52 mm.

Table 2 shows the spine dimensions and density of another cylinder liner according to the invention, taken in a section shown in FIG. 23.

TABLE 2

| | Short Dimension (mm) | Long Dimension (mm) | Area ($mm^2$) | Perimeter (mm) | Circularity $\frac{4\pi \times \text{Area}}{(\text{Perimeter})^2}$ | Spine Distance (mm) |
|---|---|---|---|---|---|---|
| Average | 0.22 | 0.30 | 0.05 | 1.11 | 0.49 | 0.55 |
| Median | 0.21 | 0.28 | 0.04 | 0.99 | 0.49 | 0.49 |
| Std. Dev. | 0.08 | 0.11 | 0.04 | 0.43 | 0.06 | 0.29 |
| Max | 0.48 | 0.67 | 0.21 | 2.71 | 0.64 | 1.33 |
| Min | 0.12 | 0.15 | 0.01 | 0.53 | 0.34 | 0.09 |

Here, the spines are separated by a distance of between. 0.09-1.33 mm.

Table 3 shows the spine dimensions and density of another cylinder liner according to the invention. Here, the spines have a distance of between 0.18-1.3 mm.

TABLE 3

| | Short Dimension (mm) | Long Dimension (mm) | Area ($mm^2$) | Perimeter (mm) | Circularity $\frac{4\pi \times \text{Area}}{(\text{Perimeter})^2}$ | Spine Distance (mm) |
|---|---|---|---|---|---|---|
| Average | 0.21 | 0.28 | 0.04 | 1.00 | 0.55 | 0.63 |
| Median | 0.21 | 0.27 | 0.04 | 0.94 | 0.55 | 0.57 |
| Std. Dev. | 0.04 | 0.07 | 0.02 | 0.22 | 0.07 | 0.30 |
| Max | 0.30 | 0.47 | 0.08 | 1.44 | 0.69 | 1.30 |
| Min | 0.13 | 0.17 | 0.02 | 0.57 | 0.40 | 0.18 |

Table 4 shows aggregate data for all three sections shown in FIGS. 22-23. The spines according to the invention have a separation of between 0.09-1.52 mm, with a median distance of 0.59 mm, measured from the peak of one spine to the peak of an adjacent spine.

TABLE 4

| | Short Dimension (mm) | Long Dimension (mm) | Area ($mm^2$) | Perimeter (mm) | Circularity $\frac{4\pi \times \text{Area}}{(\text{Perimeter})^2}$ | Spine Distance (mm) |
|---|---|---|---|---|---|---|
| Average | 0.22 | 0.30 | 0.05 | 1.08 | 0.51 | 0.64 |
| Median | 0.21 | 0.28 | 0.04 | 1.01 | 0.51 | 0.59 |
| Std. Dev. | 0.06 | 0.09 | 0.03 | 0.35 | 0.08 | 0.34 |
| Max | 0.48 | 0.67 | 0.21 | 2.71 | 0.71 | 1.52 |
| Min | 0.12 | 0.13 | 0.01 | 0.45 | 0.26 | 0.09 |

The measurements of Tables 1-4 further define the spine geometry and the measurements are summarized for reference. The area refers to the spine area as measured at the tip of each spine. Analysis software is used to determine the various geometries of the spines. One of these determinations is a basis to classify the circularity of the spine. The software may determine the circularity based on a base chart or may be determined on various measurements such as the short and long dimensions of each spine. The software also can quickly determine the spine distance between the spines. The lower spine count and elongated shape of the spines allows for a more open structure and increases the distance between the spines. The increased distance may allow for the casting material of the engine block around the liner to contact the exterior surface and minimize any gaps to improve the heat transfer between the liner into the engine block.

Referring to FIGS. 24 through 27, in this form the rough cast liner may further include a spine geometry that is elongated to increase the open areas between the spines. The open area allows for an increase of flow during some casting processes of the engine block around the liner. The spine shapes are configured to have a larger perimeter measurement and may present a "worm-like" shape having a length or long dimension that is greater than the width or short dimension. The general ranges are disclosed in the following table:

TABLE 5

Figure 25:
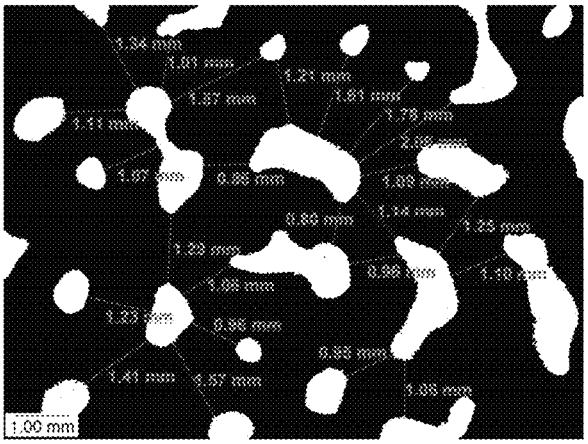
FIG. 25 is a topographical section of the liner of FIG. 24 at 1 mm above ground.
Figure 26:
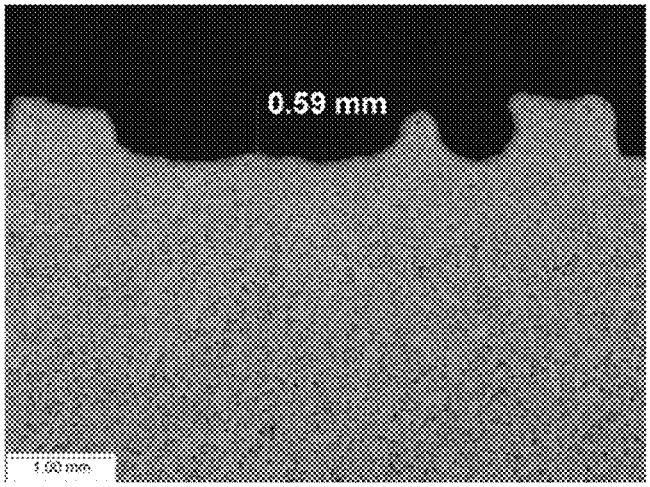
FIG. 26 is a cross-sectional view of the liner of FIG. 24, showing spine heights.

Approximate Ranges Spine Geometry for FIGS. 25 and 26

| | Approximate Range |
|---|---|
| Short Dimension (mm) | 0.3-1.5 |
| Long Dimension (mm) | 0.4-3.2 |
| Area ($mm^2$) | 0.1-2.0 |
| Area Ratio (%) | 14-22 |
| Spine Count | 20-40 |
| Circularity | 0.3-0.8 |
| Spine Distance (mm) | 0.6-2.5 |
| Spine Height | 0.4-0.7 |
| Average Spine Perimeter (mm) | 2.0-4.5 |

Figure 24:
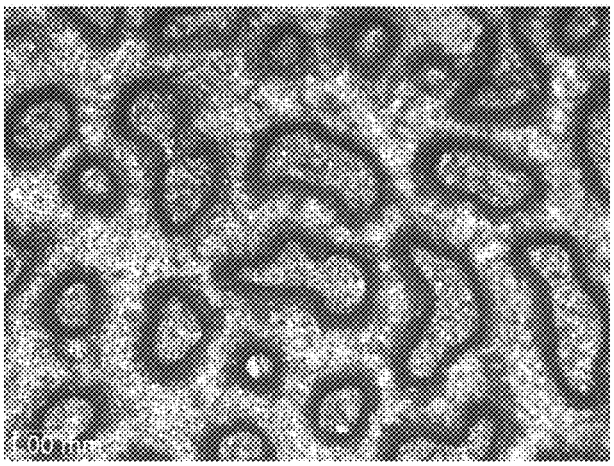
FIG. 24 is a view of another embodiment of the cylinder liner according to the invention.
Figure 27:
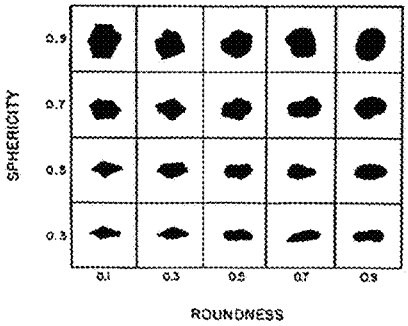
FIG. 27 is a comparison chart showing spine circularity.

The measurements of Table 5 further define the spine geometry of this form and the measurements are summarized for reference. The area refers to the spine area. The area ratio is a percentage of the area of the spines divided by the total area multiplied by 100 to determine the percentage of the spine area relative to the total area. The spine count may be determined using the same sample area and counting the number of spines and normalizing to an area of a square millimeter. The sample area of FIG. 24 is a magnification which is input into analysis software as shown in FIG. 25. The software may determine the various geometries of the spines. One of these determinations is a basis to classify the circularity of the spine. The software may determine the circularity based on a base chart as illustrated in FIG. 27. Alternatively, the circularity may be determined on various measurements such as the short and long dimensions of each spine. The software also can quickly determine the spine distance between the spines, as illustrated in FIG. 25. The lower spine count and elongated shape of the spines allows for a more open configuration and increases the distance between the spines. The increased distance may allow for the casting material of the engine block around the liner to contact the exterior surface and minimize any gaps to improve the heat transfer between the liner into the engine block.

In addition, in this form the spine height is measured as the height of the cross-section of the spine from the base surface of the casting, as illustrated in FIG. 26. The height of the spines may vary along the liner and typically within the approximate range in Table 5, above. The unique worm-like or volcano-shaped spines also have an increased perimeter measurement in comparison to a circular or oval shaped spine. The process used to produce the increased spine numbers and spine variation can be the same as the processes described above, or variations of these processes.

What is claimed is:

1. A cast cylinder liner for an internal combustion engine, having an outer surface with a plurality of spines disposed thereon, each of the spines having a length that is greater than a width, wherein the width of each spine ranges from 0.3-1.5 mm and the length of each spine ranges from 0.4-3.2 mm, wherein the liner has a spine count of 20-40 spines/cm$^2$, wherein the spines occupy an area of 14-22% of the total area of the cylinder liner, wherein the spines vary in cross-section and distances from one another, wherein a distance between at least two of the spines is 0.80 mm and a distance between at least two other of the spines is 1.78 mm and distances between any of the spines and a nearest spine is between 0.80 mm and 1.78 mm.

2. The cast cylinder liner according to claim 1, wherein each spine has a surface area of 0.1-2.0 mm$^2$.

3. The cast cylinder liner according to claim 1, wherein the spines have an average perimeter measurement of 2.0-4.5 mm.

4. The cast cylinder liner according to claim 1, wherein the spines have a height of 0.4-0.7 mm.

5. The cast cylinder liner according to claim 1, wherein the spines have a distance from one another of between 0.6-2.5 mm.

6. The cast cylinder liner according to claim 1, wherein the spines have a circularity of 0.3-0.8.

7. A cast cylinder liner for an internal combustion engine, having an outer surface with a plurality of spines disposed thereon, each of the spines having a length that is greater than a width, wherein the width of each spine ranges from 0.3-1.5 mm and the length of each spine ranges from 0.4-3.2 mm, wherein the spines have an average perimeter measurement of 2.0-4.5 mm, wherein the spines occupy an area of 14-22% of the total area of the cylinder liner, wherein the spines vary in cross-section and distances from one another, wherein a distance between at least two of the spines is 0.80 mm and a distance between at least two other of the spines is 1.78 mm and distances between any of the spines and a nearest spine is between 0.80 mm and 1.78 mm.

8. The cast cylinder liner according to claim 7, wherein the liner has a spine count of 20-40 spines/cm$^2$.

9. The cast cylinder liner according to claim 7, wherein each spine has a surface area of 0.1-2.0 mm$^2$.

* * * * *